US005838232A

United States Patent [19]

Kim et al.

[11] Patent Number: 5,838,232

[45] Date of Patent: Nov. 17, 1998

[54] MULTI-PURPOSE LOCKING DEVICE USING LASER AND OPTICAL FIBERS

[76] Inventors: Won Suk Kim, 77-23, Hwagok-dong, Kangseo-ku; Jung Hoon Rhe, 1-1068, Yongsan-dong 2-Ga, Yongsan-ku, both of Seoul, Rep. of Korea

[21] Appl. No.: 910,819

[22] Filed: Aug. 13, 1997

[51] Int. Cl.[6] ..... E05B 45/06; E05B 47/00

[52] U.S. Cl. ..... 340/542; 340/543; 70/277; 70/278; 70/DIG. 51

[58] Field of Search ..... 340/426, 427, 340/542, 543, 825.31; 70/277, DIG. 51, 278, DIG. 49; 250/229, 227.22, 551; 235/382, 380, 487

[56] References Cited

U.S. PATENT DOCUMENTS

| | | | |
|---|---|---|---|
| 4,534,194 | 8/1985 | Aydin | 70/278 |
| 5,132,661 | 7/1992 | Pinnow | 340/825.31 |
| 5,283,431 | 2/1994 | Rhine | 250/229 |
| 5,552,587 | 9/1996 | Moorhouse | 340/825.31 |

*Primary Examiner*—Brent A. Swarthout
*Assistant Examiner*—Van T. Trieu
*Attorney, Agent, or Firm*—Skjerven, Morrill, MacPherson, Franklin & Friel LLP

[57] ABSTRACT

A multi-purpose locking device including a key made of a material, which is not a metal, but a synthetic resin, thereby enabling the key to be easily carried by the user. The key also has a configuration capable of selecting a key number from numerous possible key numbers, thereby preventing even skilled lock-picking persons from opening the locking device unless the key is used. The key includes a plurality of fine apertures and block members fitted in selected ones of the apertures and adapted to close those apertures. Light receiving positions are set by the apertures not closed by the block members whereas light shielding positions are set by the apertures closed by the block members. A locked state of the locking device is unlocked only when light is received at the light receiving positions while being shielded at the light shielding positions. The locking device also includes an alarming unit adapted to generate an alarm when an incorrect key is inserted into a keyhole, thereby preventing an attempt at trespass. The multi-purpose locking device of the present invention is effectively usable for safes, gate doors and car doors.

9 Claims, 4 Drawing Sheets

MULTI-PURPOSE LOCKING DEVICE USING LASER AND OPTICAL FIBERS

BACKGROUND OF THE INVENTION

1. Field of the Invention

The present invention relates to a multi-purpose locking device using a laser and optical fibers, and more particularly to such a multi-purpose locking device usable for safes, gate doors and car doors.

2. Description of the Prior Art

It is well known that, a variety of locking devices have been proposed. Such locking devices are classified into mechanical locking devices, magnetic locking devices and locking devices using a microprocessor.

In the case of mechanical locking devices, a key is used which is inserted into the body of a locking device so that it switches the locking device between a locked state and an unlocked state as it turns. Since such mechanical locking devices are inexpensive while requiring no power source, they are most commonly used.

However, such mechanical locking devices have a low level of security in that skilled persons in the technical field, for example, safebreakers, can easily open those mechanical locking devices. Furthermore, keys used for mechanical locking devices are heavy because they are made of a material such as metal. As a result, there is an inconvenience in carrying keys. In addition, there is a problem in that when a user carries such keys in the pocket of his clothes, those keys may wear or tear the clothes as they rub against the clothes.

In the case of magnetic locking devices, magnetic pieces are buried in desired portions of the body of a magnetic locking device in such a manner that they are slidable. In this case, a key, in which magnetic pieces are buried, is used. When such a key turns under the condition in which it is inserted into the body of the locking device, the magnetic pieces buried in the body of the locking device move between their locked position and their unlocked position, thereby causing the locking device to be locked or unlocked. In such magnetic locking devices, however, there is a limitation in the number of combinations of magnetic pieces. As a result, the security level is low. In addition, the magnetic pieces of the key may lose their magnetic force due to a ferromagnetic object or heat while the user carries the key. Such a key may also damage magnetic tapes of various cards carried by the user.

In addition to the above mentioned locking devices using separate keys, an electronic door lock has also been proposed which uses no separate key. Such an electronic locking device includes a key pad provided with a plurality of numeral keys, a microprocessor, and a memory. This electronic locking device is configured so that it opens when the desired numeral keys are depressed. Accordingly, it is unnecessary to use any separate key. In this regard, there is a convenience in use.

However, such an electronic locking device has a problem in that where it is out of order or where a battery used as a power source therein has lost its charge, it can not be locked or unlocked unless an emergency key is used. Furthermore, particular numeral keys on the key pad associated with a key number for unlocking the locking device are marked as they are repeatedly depressed. For this reason, the electronic locking device exhibits a low security level after being used for a certain period of time. In addition, the use of this electronic locking device has been limited due to its high costs.

SUMMARY OF THE INVENTION

Therefore, the present invention has been made in view of the above-mentioned problems involved in the conventional locking devices and a first object of the invention is to provide a multi-purpose locking device having a configuration capable of preventing an opening of the locking device unless a key is used.

A second object of the invention is to provide a multi-purpose locking device having a configuration capable of using a key made of a material, which is not a metal, but a synthetic resin, thereby enabling the key to be easily carried by the user.

A third object of the invention is to provide a multi-purpose locking device having a configuration including a minimum number of electronic elements, thereby minimizing the failure rate.

In order to accomplish the first object, the present invention provides a multi-purpose locking device including a plurality of apertures formed at desired positions in the key insert portion of a key and at least one block member fitted in a selected one of the apertures, so that a locked state of the locking device is unlocked only when light emitted in the body of the locking device is received at desired light receiving positions respectively corresponding to the apertures not closed by the block member.

In order to accomplish the second object, the present invention provides a multi-purpose locking device including a key made of synthetic resin so as to generate no mechanical friction when the key insert portion of the key is inserted into a keyhole or separated from the keyhole.

In order to accomplish the third object, the present invention provides a multi-purpose locking device including a logic unit adapted to determine whether or not a correct key is inserted into a keyhole, the logic unit having a minimum number of constituting elements.

In accordance with the present invention, it is possible to select a key number from numerous possible key numbers obtained from numerous combinations of light receiving positions, thereby preventing even skilled lock-picking persons from opening the locking device unless a key is used. In addition, it is possible to reduce the failure rate of the locking device because the locking device has a configuration using a synthetic resin key.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
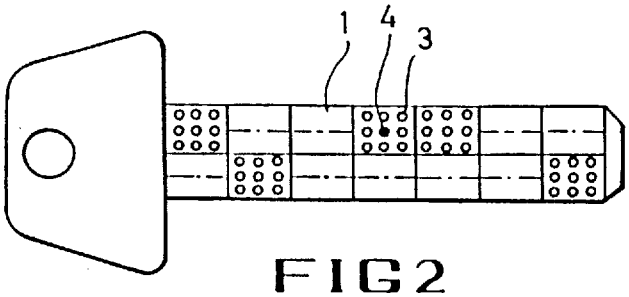
FIG. 1 is a plan view illustrating a key used in a multi-purpose locking device in accordance with the present invention.
Figure 2:
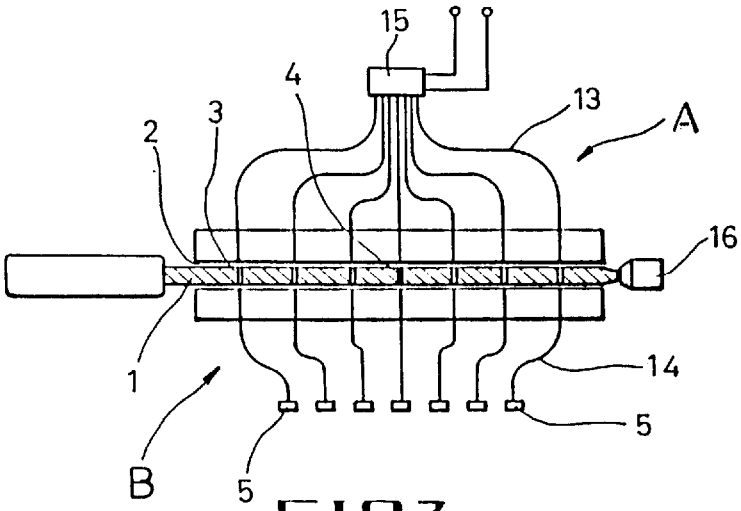
FIG. 2 is a sectional view illustrating the multi-purpose locking device of the present invention which is in a key-inserted state.

Referring to FIGS. 1 and 2, essential parts of a multi-purpose locking device according to the present invention are illustrated, respectively. FIG. 1 illustrates a key configured in accordance with the present invention whereas FIG. 2 illustrates a locking device body configured in accordance with the present invention.

As shown in FIG. 2, the locking device includes a light emitting means A and a light receiving means B arranged in the device body around a keyhole 2 formed in the device body. The light emitting means A includes a laser diode 15 and a plurality of optical fibers 13 each arranged at one end thereof adjacent to the laser diode 15 and exposed at the other end thereof to a desired portion of the keyhole 2. The light receiving means B includes a plurality of optical fibers 14 each exposed at one end thereof to a desired portion of the keyhole 2 and adapted to receive light emitted from the laser diode 15 via an associated one of the optical fibers 13, and a plurality of photo transistors 5 each coupled to the other end of an associated optical fiber 14. By such a configuration, light emitted from the laser diode 15 is sent to the photo transistors 5 via the optical fibers 13 and 14 exposed to the keyhole 2.

The photo transistors 5 are divided into a turn-on group and a turn-off group both set for an opening of the locking device. That is, the locking device can be unlocked only when those of the photo transistors 5 associated with the set turn-on transistor group turn on while the remaining photo transistors 5 associated with the set turn-off transistor group are in a turn-off state.

The key shown in FIG. 1 has, at its insert portion, apertures each arranged in such a manner that it is aligned with an associated optical fiber 13 and an associated optical fiber 14 when the insert portion of the key is inserted in position into the keyhole 2, thereby allowing light emerging from the optical fiber 13 to be transferred to the optical fiber 14. The apertures of the key correspond to the photo transistors of the turn-on transistor group, respectively. Accordingly, when the insert portion of the key is inserted into the keyhole 2, only the photo transistors 5 of the turn-on transistor group turn on while the photo transistors 5 of the turn-off transistor group are in a turn-off state, so that the locking device is unlocked. When at least one of the photo transistors 5 associated with the turn-off transistor group turns on as it receives light emitted from the laser diode 15, the unlocking of the locking device is prevented because it is regarded that an incorrect key is inserted into the keyhole 2. In this case, an alarm is generated so as to prevent an attempt at trespass.

Figure 3:
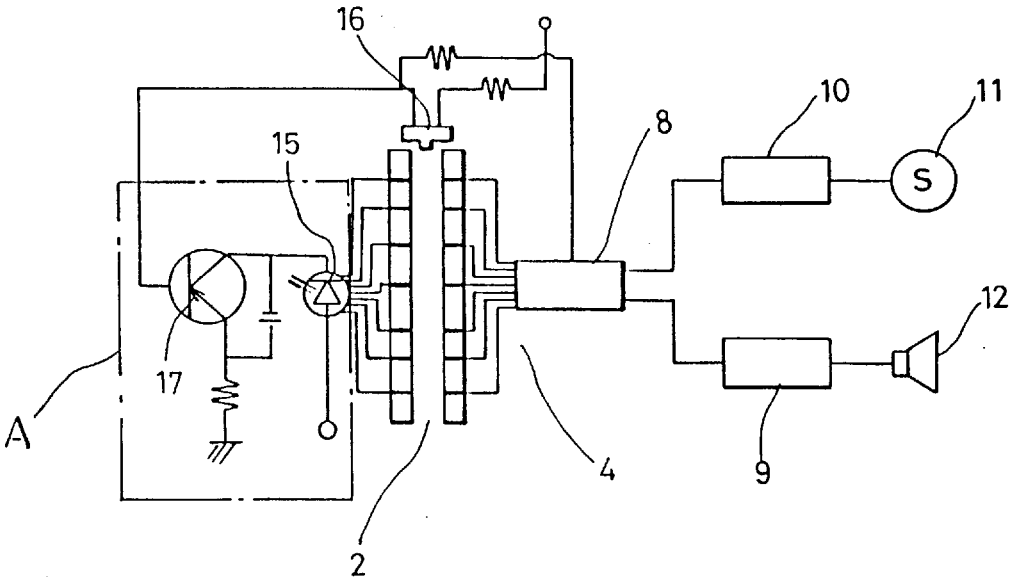
FIG. 3 is a circuit diagram illustrating the entire configuration of the multi-purpose locking device in accordance with the present invention.
Figure 4:
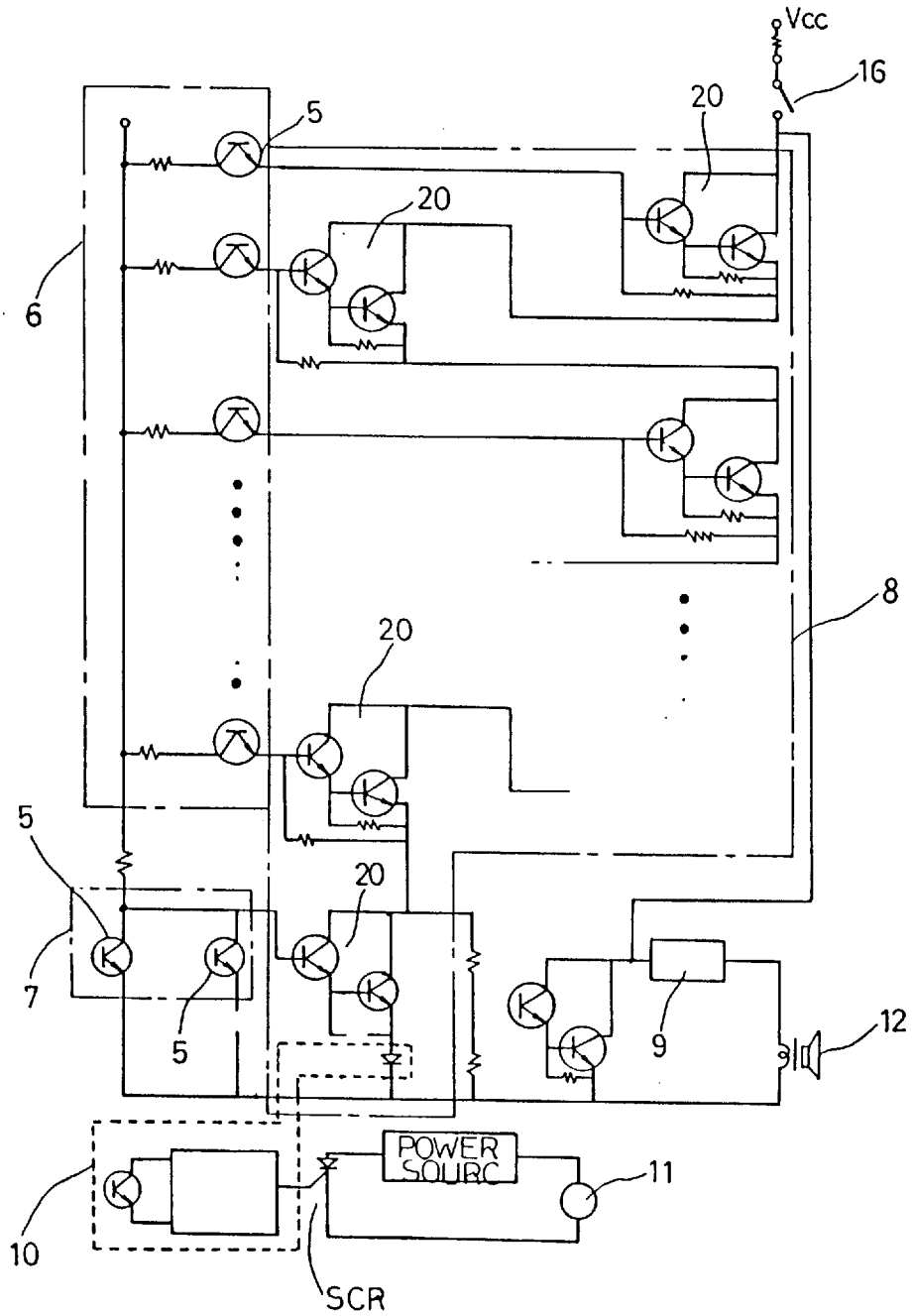
FIG. 4 is a circuit diagram illustrating an electrical configuration of the multi-purpose locking device in accordance with an embodiment of the present invention.

Referring to FIGS. 3 and 4, a circuit configuration of the multi-purpose locking device according to the present invention is illustrated. As shown in FIG. 3, a protective film is formed around the keyhole 2 of the device body. A microswitch 16 is arranged in the device body adjacent to an inward end of the keyhole 2. A transistor 17 is coupled between the laser diode 15 and microswitch 16, as shown in FIG. 4. The function of the microswitch 16 will be described hereinafter. Each optical fiber 13, which is included in the light emitting means A and disposed at one end thereof adjacent to the laser diode 15, is fixed at the other end thereof to the protective film. Similarly, each optical fiber 14 included in the light receiving means B is fixed at one end thereof to the protective film in such a manner that the end faces the end of an associated optical fiber 13 fixed to the protective film. As mentioned above, each optical fiber 14 is also coupled at the other end thereof to an associated one of the photo transistors 5. In FIG. 4, the turn-on group and turn-off group of the photo transistors 5 are denoted by the reference numerals 6 and 7 respectively. The locking device also includes a logic unit 8 activated by an output from the turn-on transistor group 6, a drive unit 10 activated by an output from the logic unit 8, and an unlocking unit driven by the drive unit 10. The logic unit 8 includes a plurality of Darlington circuits 20 respectively coupled to all the photo transistors 5 of the turn-on transistor group 6. The Darlington circuits 20 are connected in series to a power source Vcc. The logic unit 8 also includes a Darlington circuit 20 coupled to all the photo transistors 5 of the turn-off transistor group 7. The Darlington circuit 20 associated with the turn-off transistor group 7 is connected in series to the Darlington circuits 20 associated with the turn-on transistor group 6. The drive unit 10 includes a photo coupler having a photo diode and a switching circuit having a solid state relay (SSR) or SCR whereas the unlocking unit includes a solenoid 11 activated by the drive unit 10. The locking device further includes an alarming unit 9 activated by an output from the turn-off transistor group 7, and a speaker 12 coupled to the alarming unit 9 and adapted to generate an alarm based on an output from the alarming unit 9. The photo diode of the photo coupler included in the drive unit 10 is coupled to the logic unit 8.

In association with the above-mentioned configuration, the key has a key insert portion 1 formed with a plurality of apertures 3 each arranged in such a manner that it is aligned with an associated optical fiber 13 and an associated optical fiber 14 when the insert portion 1 of the key is inserted into the keyhole 2, thereby allowing light emerging from the optical fiber 13 to be transferred to the optical fiber 14. As shown in FIG. 1, the key insert portion 1 is divided into a plurality of aperture areas each formed with a plurality of apertures 3. In the illustrated case, the key insert portion 1 has 14 aperture areas each having 9 apertures 3. Block members 4 are fitted in selected apertures 3, respectively.

Now, the operation of the multi-purpose locking device having the above-mentioned configuration according to the present invention will be described in detail in conjunction with FIGS. 3 and 4.

In accordance with the above-mentioned configuration, each optical fiber 13 receives a laser beam emitted from the light emitting means A at one end thereof and outputs the received laser beam at the other end thereof exposed to the keyhole 2. The light beam emerged from each optical fiber 13 is sent to an associated one of the optical fibers 14 included in the light receiving means B under the condition in which the aperture 3 of the key aligned with the optical fibers 13 and 14 is open or empty.

Each aperture area of the key corresponds to one digit of a key number for the locking device. In the case illustrated in FIG. 1, each aperture area corresponds to a numeral which may be one of "0" to "9". For example, the numeral of each aperture area may be determined in such a manner that it corresponds to "0" when all the apertures of the aperture area are closed while corresponding to "9" when all the apertures are open. Accordingly, a key number of 14 digits is set in the illustrated case. In accordance with a combination of such 14 digits each being one of "0" to "9", there may be about ten trillion key numbers in the illustrated case. Therefore, it is impossible to find a key number optionally selected from numerous key numbers.

When the key insert portion 1 of the key is inserted in position into the keyhole 2, the microswitch 16 turns on, thereby causing the transistor 17 to turn on. In the turn-on state of the transistor 17, the laser diode 15 connected to the transistor 17 emits a laser beam, which is, in turn, sent to the keyhole 2 via the optical fibers 13 of the light emitting means A.

Laser beams emerging from the optical fibers 13 pass partially through the open apertures 3 of the key inserted in the keyhole 2 while being partially shielded by the closed apertures 3 of the key. The laser beams passing through the open apertures 3 of the key are incident on the optical fibers 14 of the light receiving means B respectively exposed to the open apertures 3 and then sent to the photo transistors 5 respectively coupled to those optical fibers 14.

In the case illustrated in FIG. 4, the locking device can be unlocked only when all the photo transistors 5 of the turn-on group 6, which consists of N photo transistors, receive laser beams, respectively, while all the photo transistors 5 of the turn-off group 7, which consists of 2 photo transistors, receive no laser beam by the block members 4.

When all the photo transistors 5 of the turn-on transistor group 6 turn on as they receive laser beams under the condition in which all the photo transistors 5 of the turn-off transistor group 7 are maintained in a turn-off state, all the Darlington circuits 20 of the logic unit 8 associated with both the turn-on and turn-off transistor group 6 and 7 turn on. As a result, current flows through the photo diode of the photo coupler included in the drive unit 10, thereby causing the photo transistor of the photo coupler to turn on.

In the turn-on state of the photo transistor of the photo coupler, the switching circuit of the drive unit 10 is activated, thereby activating its SSR or SCR. As a result, the solenoid 11 of the unlocking unit is activated to perform an operation for unlocking the locked state of the locking device.

Since the locking device is configured to unlock its locked state using the solenoid, it may be used for a variety of purposes, for example, purposes for opening gate doors and car doors.

Where an incorrect key, which has at least one block member position different from the correct key associated with the locking device, is inserted into the keyhole 2, the optical fiber 14 of the light receiving means B corresponding to the incorrect block member position receives no laser beam.

In this case, at least one of the photo transistors 5 in the turn-on transistor group 6 receives no laser beam, so that it is maintained in a turn-off state. As a result, no current flows through the photo diode of the photo coupler included in the drive unit 10, thereby causing the SSR or SCR of the drive unit 10 to maintain its inactive state. Accordingly, the locked state of the locking device is maintained. Meanwhile, at least one of the photo transistors 5 in the turn-off transistor group 7 receives a laser beam, so that it turns on, thereby causing the Darlington circuit 20 coupled to the turn-on transistor 5 to turn off. As a result, a high level input is applied to the alarming unit 9 which, in turn, turns on, thereby causing the speaker 12 to be activated. Accordingly, an alarm is generated from the speaker 12. Thus, an attempt at trespass and burglary are prevented.

Figure 5A:
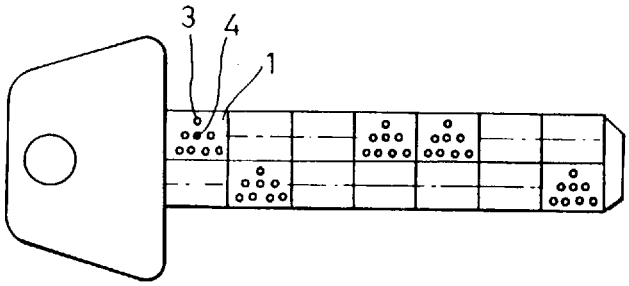
FIGS. 5A, 5B and 5C are plan views respectively illustrating different embodiments of the key used in the multi-purpose locking device of the present invention.
Figure 5B:
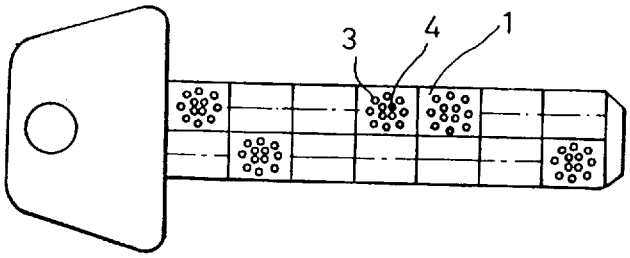
Figure 5C:
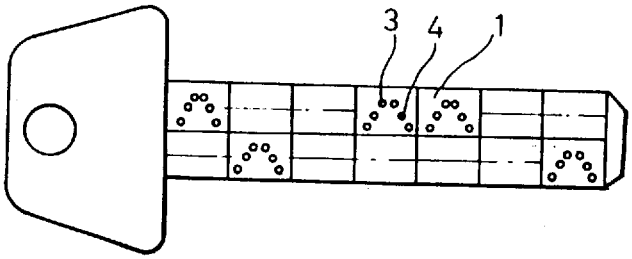

In accordance with the present invention, the arrangement of apertures 3 formed in each aperture area of the key may have a triangular shape as shown in FIG. 5A, a circular shape as shown in FIG. 5B, or a wave shape as shown in FIG. 5C. The arrangement of apertures 3 may also have an optional shape other than the illustrated shapes. Accordingly, it is possible to further increase the number of possible key numbers.

Furthermore, it is possible to further increase the number of possible key numbers by optionally vary the positions and number of block members 4.

Figure 6:
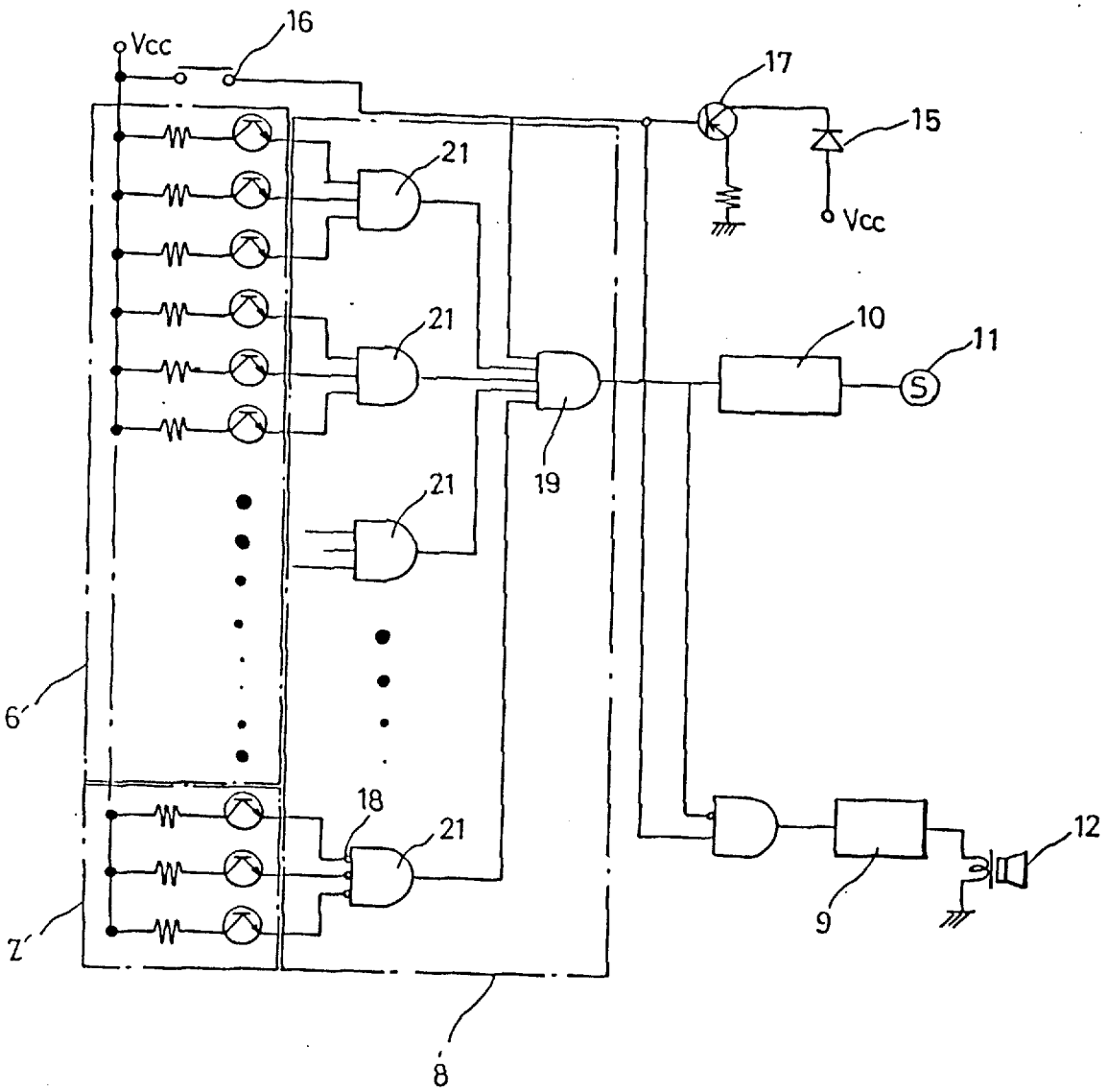
FIG. 6 is a circuit diagram illustrating an electrical configuration of the multi-purpose locking device in accordance with another embodiment of the present invention.

Although the logic circuit has been described as being constituted by Darlington circuits using transistors, it may be constitute by hybrid IC's or digital IC's. FIG. 6 illustrates an embodiment of the present invention in which the logic circuit is constituted by digital IC's. In this case, it is possible to provide a light and compact configuration. It is also possible to greatly reduce the number of assembling process steps, thereby increasing the productivity.

In accordance with the embodiment of the present invention illustrated in FIG. 6, the logic unit, which is denoted by the reference numeral 8', includes a plurality of AND gates 21 to which groups of the photo transistors 5 in the turn-on transistor group 6 are coupled, respectively. The logic unit 8' also includes an AND gate 21 to which all the photo transistors 5 in the turn-off transistor group 7 are coupled via inverters 18. All the AND gates 21 are coupled at their outputs to the input of an AND gate 19. In this embodiment, the microswitch 16 is also coupled to the input of the AND gate 19. The microswitch 16 is also coupled to the alarming unit 9 via an AND gate to which the output of the AND gate 19 is coupled via an inverter.

In accordance with this configuration, the AND gates 21 coupled to the photo transistors 5 of the turn-on transistor group 6 generate high-level outputs, respectively, when all the photo transistors 5 of the turn-on transistor group 6 turn on as they receive laser beams via associated optical fibers 14. The AND gate 21 coupled to the photo transistors 5 of the turn-off transistor group 7 generates a high-level output when all the photo transistors 5 of the turn-off transistor group 6 are maintained in a turn-off state as they receive no laser beam via associated optical fibers 14 due to the block members 4 of the key. When all the AND gates 21 associated with both the turn-on and turn-off transistor groups 6 and 7 generate high-level outputs, the AND gate 19 generates a high-level output. By the high-level output from the AND gate 19, the drive unit operates to activate the solenoid 11. In this state, the solenoid 11 operates to unlock the locked state of the locking device.

Where an incorrect key, which has at least one block member position different from the correct key associated with the locking device, is inserted into the keyhole 2, the optical fiber 14 of the light receiving means B corresponding to the incorrect block member position receives no laser beam even though the microswitch 16 is switched on to activate the laser diode 15. In this case, at least one of the AND gates 21 generates a low-level output, thereby causing the AND gate 19 to generate a low-level output. As a result, the drive unit 10 is maintained in an inactive state. At this time, the AND gate receiving the output from the AND gate 19 and the output from the microswitch 16 generates a high-level output which, in turn, turns on the alarming unit 9. In the turn-on state of the alarming unit 9, the speaker 12 generates an alarm. Thus, an attempt at trespass and burglary are prevented.

As apparent from the above description, the present invention provides a multi-purpose locking device having a configuration capable of selecting a key number from numerous key numbers, thereby preventing even skilled lock-picking persons from opening the locking device unless a key is used. This locking device provides a high reliability where it is applied to safes, gate doors and car doors. In accordance with the present invention, the multi-purpose locking device may have a configuration capable of using a key made of a material, which is not a metal, but a synthetic resin. Accordingly, the key can be easily carried by the user by virtue of its light construction. In addition, it is possible to prevent the key from wearing or tearing the clothes of the user. The locking device of the present invention also has a simple configuration as compared to a conventional configuration using a microprocessor, thereby minimizing its failure rate. Since the locking device of the present invention uses a laser and optical fibers, it is possible to rapidly and accurately transfer an unlocking signal to a remote place. Accordingly, the locking and unlocking units of the locking device can be placed at different positions remote from each other, respectively. For instance, where the locking unit of the locking device is installed at a storehouse, it is possible to install the unlocking unit of the locking device at a place remote from the storehouse, for example, at a management office. The locking and unlocking operations of the locking unit can be controlled at a remote place. In particular, it is possible to manage a plurality of storehouses in a centralized manner using the locking device of the present invention which includes a plurality of locking units respectively installed at the storehouses and a single unlocking unit for controlling the locking units. Thus, the present invention provides for easy management of storehouses while reducing waste of labor.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A multi-purpose locking device comprising a locking device body having a keyhole and a key having a key insert portion selectively inserted into the keyhole to unlock a locked state of the locking device, further comprising:

a plurality of apertures formed in the key insert portion of the key;

at least one block member fitted in a selected one of the apertures and adapted to close the selected aperture;

a light emitting unit exposed at an output thereof to the keyhole of the locking device body;

a light receiving unit adapted to receive light emitted from the light emitting unit through the apertures, not closed, of the key insert portion under the condition in which the key is inserted into the keyhole, the light receiving unit including a plurality of photo transistors grouped into a turn-on transistor group and a turn-off transistor group, the photo transistors in the turn-on transistor grouped being for receiving light from the light emitting unit, light from the light emitting unit being blocked from the photo transistors in the turn-off transistor group by the at least one block member;

a logic unit adapted to determine the level of an output from the light receiving unit;

a solenoid adapted to unlock the locked state of the locking device;

a drive unit coupled to the logic unit and adapted to drive the solenoid based on a first output signal from the logic unit; and an alarming unit activated by a second output signal from the logic unit and adapted to generate an alarm through a speaker coupled thereto.

2. The multi-purpose locking device in accordance with claim 1, wherein the light emitting unit comprises a light source and a plurality of optical fibers each adapted to receive light emitted from the light source at one end thereof and exposed at the other end thereof to the keyhole in such a manner that it is exposed to an associated one of the apertures of the key inserted in the keyhole, and the light receiving unit further comprises a plurality of optical fibers each exposed at one end thereof to the key hole in such a manner that it receives light from an associated one of the optical fibers of the light emitting unit through an associated one of the apertures of the key inserted in the keyhole while being coupled at the other end thereof to an associated one of the photo transistors.

3. The multi-purpose locking device in accordance with claim 2, wherein the light source is a laser diode.

4. The multi-purpose locking device in accordance with claim 2, further comprising:

a microswitch adapted to sense an insertion of the key into the keyhole; and a transistor coupled between the microswitch and the light source, the transistor turning on/off by an output from the microswitch, thereby turning on/off the light source.

5. The multi-purpose locking device in accordance with claim 4, wherein the microswitch is coupled to the logic unit and the alarming unit.

6. The multi-purpose locking device in accordance with claim 1, wherein the drive unit includes a switching element consisting of a solid state relay, the switching element serving to control electric power supplied to the solenoid based on the first output signal from the logic unit.

7. The multi-purpose locking device in accordance with claim 1, wherein the drive unit includes a switching element consisting of a silicon controlled rectifier, the switching element serving to control electric power supplied to the solenoid based on the first output signal from the logic unit.

8. The multi-purpose locking device in accordance with claim 1, wherein the logic unit comprises a plurality of Darlington circuits each consisting of transistors.

9. The multi-purpose locking device in accordance with claim 1, wherein the logic unit comprises a plurality of digital integrated circuits each consisting of an AND gate.

* * * * *